US008103006B2

(12) United States Patent
McGrath

(10) Patent No.: US 8,103,006 B2
(45) Date of Patent: Jan. 24, 2012

(54) SPATIAL RESOLUTION OF THE SOUND FIELD FOR MULTI-CHANNEL AUDIO PLAYBACK SYSTEMS BY DERIVING SIGNALS WITH HIGH ORDER ANGULAR TERMS

(75) Inventor: David Stanley McGrath, Sydney (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 500 days.

(21) Appl. No.: 12/311,270

(22) PCT Filed: Sep. 19, 2007

(86) PCT No.: PCT/US2007/020284

§ 371 (c)(1), (2), (4) Date: Mar. 23, 2009

(87) PCT Pub. No.: WO2008/039339

PCT Pub. Date: Apr. 3, 2008

(65) Prior Publication Data

US 2009/0316913 A1 Dec. 24, 2009

Related U.S. Application Data

(60) Provisional application No. 60/847,322, filed on Sep. 25, 2006.

(51) Int. Cl.
*H04R 5/00* (2006.01)

(52) U.S. Cl. ..... 381/20; 381/18; 381/19; 381/1

(58) Field of Classification Search ..... 381/1, 17, 381/18, 19, 20, 22, 23

See application file for complete search history.

(56) References Cited

U.S. PATENT DOCUMENTS

| | | | | |
|---|---|---|---|---|
| 4,063,034 | A * | 12/1977 | Peters | 381/17 |
| 5,757,927 | A | 5/1998 | Gerzon et al. | |
| 5,890,125 | A * | 3/1999 | Davis et al. | 704/501 |
| 6,072,878 | A | 6/2000 | Moorer | |

FOREIGN PATENT DOCUMENTS

| | | |
|---|---|---|
| GB | 2 045 586 A | 10/1980 |
| JP | S52-134701 | 11/1977 |
| SU | 145625 | 1/1962 |
| WO | WO 00/19415 A | 4/2000 |

OTHER PUBLICATIONS

I.A. Aldoshina, Amniophy, Show Master Journal, No. 1, 2005(40).
EP Int'l. Search Report, Apr. 3, 2008, Dolby Laboratories Licens.
EP Written Opinion of ISA, Apr. 3, 2008, Dolby Laboratories Licens.

* cited by examiner

*Primary Examiner* — Thinh T Nguyen

(57) ABSTRACT

Audio signals that represent a sound field with increased spatial resolution are obtained by deriving signals that represent the sound field with high-order angular terms. This is accomplished by analyzing input audio signals representing the sound field with zero-order and first-order angular terms to derive statistical characteristics of one or more angular directions of acoustic energy in the sound field. Processed signals are derived from weighted combinations of the input audio signals in which the input audio signals are weighted according to the statistical characteristics. The input audio signals and the processed signals represent the sound field as a function of angular direction with angular terms of one or more orders greater than one.

24 Claims, 10 Drawing Sheets

SPATIAL RESOLUTION OF THE SOUND FIELD FOR MULTI-CHANNEL AUDIO PLAYBACK SYSTEMS BY DERIVING SIGNALS WITH HIGH ORDER ANGULAR TERMS

TECHNICAL FIELD

The present invention pertains generally to audio and pertains more specifically to devices and techniques that can be used to improve the perceived spatial resolution of a reproduction of a low-spatial resolution audio signal by a multi-channel audio playback system.

BACKGROUND ART

Multi-channel audio playback systems offer the potential to recreate accurately the aural sensation of an acoustic event such as a musical performance or a sporting event by exploiting the capabilities of multiple loudspeakers surrounding a listener. Ideally, the playback system generates a multi-dimensional sound field that recreates the sensation of apparent direction of sounds as well as diffuse reverberation that is expected to accompany such an acoustic event.

At a sporting event, for example, a spectator normally expects directional sounds from the players on an athletic field would be accompanied by enveloping sounds from other spectators. An accurate recreation of the aural sensations at the event cannot be achieved without this enveloping sound. Similarly, the aural sensations at an indoor concert cannot be recreated accurately without recreating reverberant effects of the concert hall.

The realism of the sensations recreated by a playback system is affected by the spatial resolution of the reproduced signal. The accuracy of the recreation generally increases as the spatial resolution increases. Consumer and commercial audio playback systems often employ larger numbers of loudspeakers but, unfortunately, the audio signals they play back may have a relatively low spatial resolution. Many broadcast and recorded audio signals have a lower spatial resolution than may be desired. As a result, the realism that can be achieved by a playback system may be limited by the spatial resolution of the audio signal that is to be played back. What is needed is a way to increase the spatial resolution of audio signals.

DISCLOSURE OF INVENTION

It is an object of the present invention to provide for the increase of spatial resolution of audio signals representing a multi-dimensional sound field.

This object is achieved by the invention described in this disclosure. According to one aspect of the present invention, statistical characteristics of one or more angular directions of acoustic energy in the sound field are derived by analyzing three or more input audio signals that represent the sound field as a function of angular direction with zero-order and first-order angular terms. Two or more processed signals are derived from weighted combinations of the three or more input audio signals. The three or more audio signals are weighted in the combination according to the statistical characteristics. The two or more processed signals represent the sound field as a function of angular direction with angular terms of one or more orders greater than one. The three or more input audio signals and the two or more processed signals represent the sound field as a function of angular direction with angular terms of order zero, one and greater than one.

The various features of the present invention and its preferred embodiments may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

A. Introduction

Figure 1:
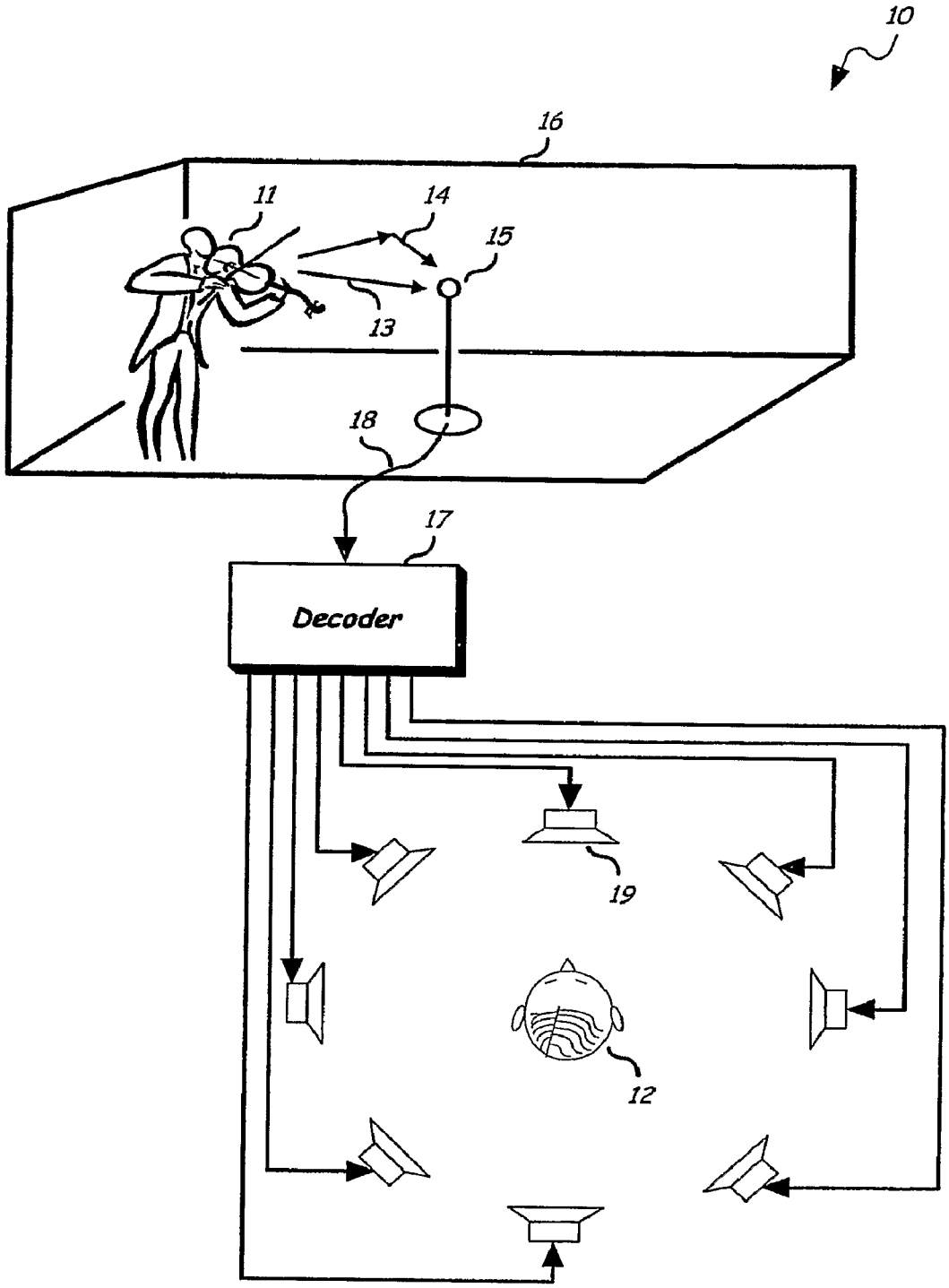
FIG. 1 is a schematic diagram of an acoustic event captured by a microphone system and subsequently reproduced by a playback system.

FIG. 1 provides a schematic illustration of an acoustic event 10 and a decoder 17 incorporating aspects of the present invention that receives audio signals 18 representing sounds of the acoustic event captured by the microphone system 15. The decoder 17 processes the received signals to generate processed signals with enhanced spatial resolution. The processed signals are played back by a system that includes an array of loudspeakers 19 arranged in proximity to one or more listeners 12 to provide an accurate recreation of the aural sensations that could have been experienced at the acoustic event. The microphone system 15 captures both direct sound waves 13 and indirect sound waves 14 that arrive after reflection from one or more surfaces in some acoustic environment 16 such as a room or a concert hall.

In one implementation, the microphone system 15 provides audio signals that conform to the Ambisonic four-channel signal format (W, X, Y, Z) known as B-format. The SPS422B microphone system and MKV microphone system available from SoundField Ltd., Wakefield, England, are two examples that may be used. Details of implementation using SoundField microphone systems are discussed below. Other microphone systems and signal formats may be used if desired without departing from the scope of the present invention.

Figure 2:
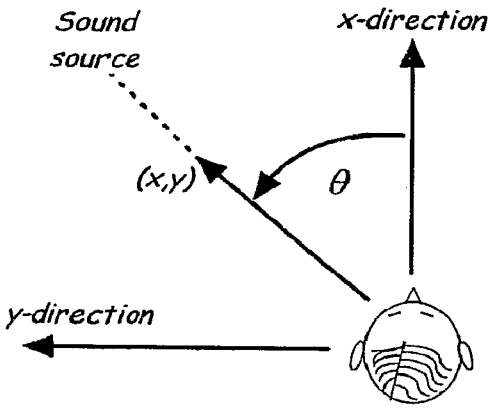
FIG. 2 illustrates a listener and the apparent azimuth of a sound.

The four-channel (W, X, Y, Z) B-format signals can be obtained from an array of four co-incident acoustic transducers. Conceptually, one transducer is omni-directional and three transducers have mutually orthogonal dipole-shaped patterns of directional sensitivity. Many B-format microphone systems are constructed from a tetrahedral array of four directional acoustic transducers and a signal processor that generates the four-channel B-format signals in response to the output of the four transducers. The W-channel signal represents an omnidirectional sound wave and the X, Y and Z-channel signals represent sound waves oriented along three mutually orthogonal axis that are typically expressed as functions of angular direction with first-order angular terms θ. The X-axis is aligned horizontally from back to front with respect to a listener, the Y-axis is aligned horizontally from right to left with respect to the listener, and the Z axis is aligned vertically upward with respect to the listener. The X and Y axes are illustrated in FIG. 2. FIG. 2 also illustrates the apparent azimuth θ of a sound, which can be expressed as a vector (x,y). By constraining the vector to have unit length, it may be seen that:

$$x^2+y^2=1 \tag{1}$$

$$(x,y)=(\cos\theta, \sin\theta) \tag{2}$$

The four-channel B-format signals can convey three-dimensional information about a sound field. Applications that require only two-dimensional information about a sound field can use a three-channel (W, X, Y) B-format signal that omits the Z-channel. Various aspects of the present invention can be applied to two- and three-dimensional playback systems but the remaining disclosure makes more particular mention of two-dimensional applications.

B. Signal Panning

Figure 3:
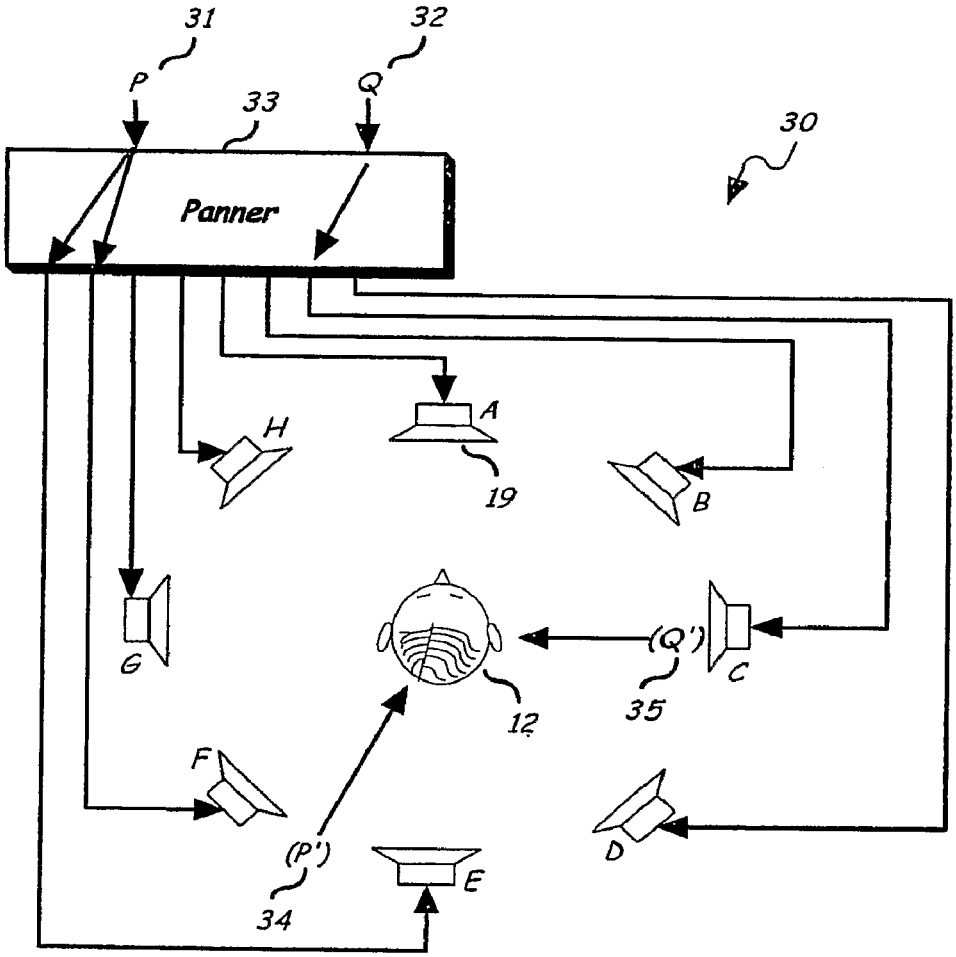
FIG. 3 illustrates a portion of an exemplary playback system that distributes signals to loudspeakers to recreate a sensation of direction.

FIG. 3 illustrates a portion of an exemplary playback system with eight loudspeakers surrounding the listener 12. The figure illustrates a condition in which the system is generating a sound field in response to two input signals P and Q representing two sounds with apparent directions P' and Q', respectively. The panner component 33 processes the input signals P and Q to distribute or pan processed signals among the loudspeaker channels to recreate the sensation of direction. The panner component 33 may use a number of processes. One process that may be used is known as the Nearest Speaker Amplitude Pan (NSAP).

The NSAP process distributes signals to the loudspeaker channels by adapting the gain for each loudspeaker channel in response to the apparent direction of a sound and the locations of the loudspeakers relative to a listener or listening area. In a two-dimensional system, for example, the gain for the signal P is obtained from a function of the azimuth $\theta_P$ of the apparent direction for the sound this signal represents and of the azimuths $\theta_F$ and $\theta_E$ of the two loudspeakers SF and SE, respectively, that lie on either side of the apparent direction $\theta_P$. In one implementation, the gains for all loudspeaker channels other than the channels for these nearest two loudspeakers are set to zero and the gains for the channels of the two nearest loudspeakers are calculated according to the following equations:

$$Gain_{SE}(\theta_P) = \frac{|\theta_P - \theta_F|}{|\theta_E - \theta_F|} \tag{3a}$$

$$Gain_{SF}(\theta_P) = \frac{|\theta_P - \theta_E|}{|\theta_E - \theta_F|} \tag{3b}$$

Similar calculations are used to obtain the gains for other signals. The signal Q represents a special case where the apparent direction $\theta_Q$ of the sound it represents is aligned with one loudspeaker SC. Either loudspeaker SB or SD may be selected as the second nearest loudspeaker. As may be seen from equations 1a and 1b, the gain for the channel of the loudspeaker SC is equal to one and the gains for all other loudspeaker channels are zero.

Figure 4:
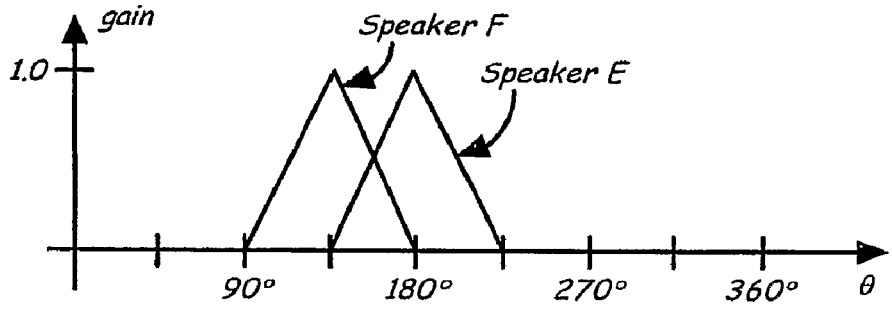
FIG. 4 is a graphical illustration of gain functions for the channels of two adjacent loudspeakers in a hypothetical playback system.

The gains for the loudspeaker channels may be plotted as a function of azimuth. The graph shown in FIG. 4 illustrates gain functions for channels of the loudspeakers $S_E$ and $S_F$ in the system shown in FIG. 3 where the loudspeakers $S_E$ and $S_F$ are separated from each other and from their immediate neighbors by an angle equal to 45 degrees. The azimuth is expressed in terms of the coordinate system shown in FIG. 2. When a sound such as that represented by the signal P has an apparent direction between 135 degrees and 180 degrees, the gains for loudspeakers SE and SF will be between zero and one and the gains for all other loudspeakers in the system will be set to zero.

C. Microphone Gain Patterns

Systems can apply the NSAP process to signals representing sounds with discrete directions to generate sound fields that are capable of accurately recreating aural sensations of an original acoustic event. Unfortunately, microphone systems do not provide signals representing sounds with discrete directions.

When an acoustic event 10 is captured by the microphone system 15, sound waves 13, 14 typically arrive at the microphone system from a large number of different directions. The microphone systems from SoundField Ltd. mentioned above generate signals that conform to the B-format. Four-channel (W, X, Y, Z) B-format signals may be generated to convey three-dimensional characteristics of a sound field expressed as functions of angular direction. By ignoring the Z-channel signal, three-channel (W, X, Y) B-format signals may be obtained to represent two-dimensional characteristics of a sound field that also are expressed as functions of angular direction. What is needed is a way to process these signals so that aural sensations can be recreated with a spatial accuracy similar to what can be achieved by the NSAP process when applied to signals representing sounds with discrete directions. The ability to achieve this degree of spatial accuracy is hindered by the spatial resolution of the signals that are provided by the microphone system 15.

The spatial resolution of a signal obtained from a microphone system depends on how closely the actual directional pattern of sensitivity for the microphone system conforms to some ideal pattern, which in turn depends on the actual directional pattern of sensitivity for the individual acoustic transducers within the microphone system. The directional pattern of sensitivity for actual transducers may depart significantly from some ideal pattern but signal processing can compensate for these departures from the ideal patterns. Signal processing can also convert transducer output signals into a desired format such as the B-format. The effective directional pattern including the signal format of the transducer/processor system is the combined result of transducer directional sensitivity and signal processing. The microphone systems from SoundField Ltd. mentioned above are examples of this approach. This detail of implementation is not critical to the present invention because it is not important how the effective directional pattern is achieved. In the remainder of this discussion, terms like "directional pattern" and "directivity" refer to the effective directional sensitivity of the transducer or transducer/processor combination used to capture a sound field.

Figure 8:
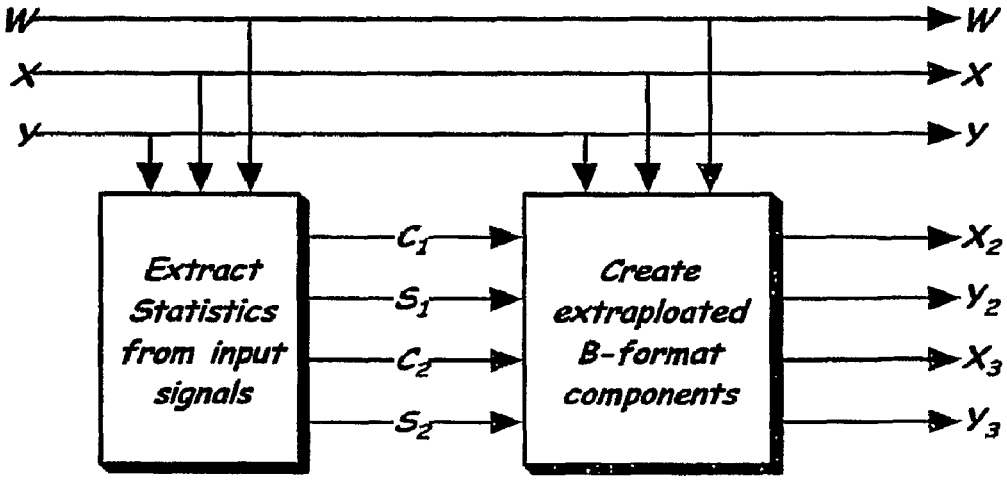
FIGS. 8 and 9 are schematic block diagrams of an approach for deriving higher-order terms from three-channel (W, X, Y) B-format signals.

A two-dimensional directional pattern of sensitivity for a transducer can be described as a gain pattern that is a function of angular direction $\theta_?$ which may have a form that can be expressed by either of the following equations:

$$\text{Gain}(a,\theta)=(1-a)+a\cdot\cos\theta \tag{4a}$$

$$\text{Gain}(a,\theta)=(1-a)+a\cdot\sin\theta \tag{4b}$$

where a=0 for an omnidirectional gain pattern;

a=0.5 for a cardioid-shaped gain pattern; and a=1 for a figure-8 gain pattern.

These patterns are expressed as functions of angular direction with first-order angular terms θ and are referred to herein as first-order gain patterns.

In typical implementations, the microphone system 15 uses three or four transducers with first-order gain patterns to provide three-channel (W, X, Y) B-format signals or four-channel (W, X, Y, Z) B-format signals that convey two- or three-dimensional information about a sound field. Referring to equations 4a and 4b, a gain pattern for each of the three B-format signal channels (W, X, Y) may be expressed as:

$$\text{Gain}_W(\theta)=\text{Gain}(a=0,\theta)=1 \tag{5a}$$

$$\text{Gain}_X(\theta)=\text{Gain}(a=1,\theta)=\cos\theta=x \tag{5b}$$

$$\text{Gain}_Y(\theta)=\text{Gain}(a=1,\theta)=\sin\theta=y \tag{5c}$$

where the W-channel has an omnidirectional zero-order gain pattern as indicated by a=0 and the X and Y-channels have a figure-8 first-order gain pattern as indicated by a=1.

D. Playback System Resolution

The number and placement of loudspeakers in a playback array may influence the perceived spatial resolution of a recreated sound field. A system with eight equally-spaced loudspeakers is discussed and illustrated here but this arrangement is merely an example. At least three loudspeakers are needed to recreate a sound field that surrounds a listener but five or more loudspeakers are generally preferred. In preferred implementations of a playback system, the decoder 17 generates an output signal for each loudspeaker that is decorrelated from other output signals as much as possible. Higher levels of decorrelation tend to stabilize the perceived direction of a sound within a larger listening area, avoiding well known localization problems for listeners that are located outside the so-called sweet spot.

Figure 5:
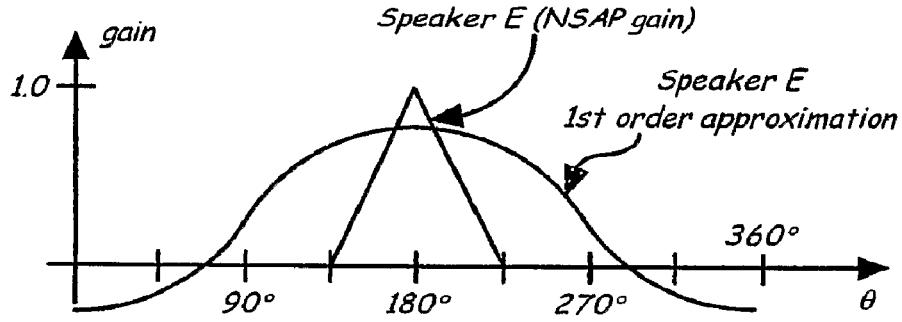
FIG. 5 is a graphical illustration of gain functions that shows a degradation in spatial resolution resulting from a mix of first-order signals.

In one implementation of a playback system according to the present invention, the decoder 17 processes three-channel (W, X, Y) B-format signals that represent a sound field as a function of direction with only zero-order and first-order angular terms to derive processed signals that represent the sound field as a function of direction with higher-order angular terms that are distributed to one or more loudspeakers. In conventional systems, the decoder 17 mixes signals from each of the three B-format channels into a respective processed signal for each of the loudspeakers using gain factors that are selected based on loudspeaker locations. Unfortunately, this type of mixing process does not provide as high a spatial resolution as the gain functions used in the NSAP process for typical systems as described above. The graph illustrated in FIG. 5, for example, shows a degradation in spatial resolution for the gain functions that result from a linear mix of first-order B-format signals.

The cause of this degradation in spatial resolution can be explained by observing that the precise azimuth $\theta_P$ of a sound P with amplitude R is not measured by the microphone system 15. Instead, the microphone system 15 records three signals W=R. X=R·cos $\theta_P$ and Y=R·sin $\theta_P$ that represent a sound field as a function of direction with zero-order and first-order angular terms. The processed signal generated for loudspeaker SE, for example, is composed of a linear combination of the W, X and Y-channel signals.

The gain curve for this mixing process can be looked at as a low-order Fourier approximation to the desired NSAP gain function. The NSAP gain function for the SE loudspeaker channel shown in FIG. 4, for example, may be represented by a Fourier series $$\text{Gain}_{SE}(\theta)=a_0+a_1\cos\theta+b_1\sin\theta+a_2\cos 2\theta+b_2\sin 2\theta+a_3\cos 3\theta+b_3\sin 3\theta+\ldots \tag{6}$$

but the mixing process of a typical decoder omits terms above the first order, which can be expressed as:

$$\text{Gain}_{SE}(\theta)=a_0+a_1\cos\theta+b_1\sin\theta \tag{7}$$

The spatial resolution of the processing function for the decoder 17 can be increased by including signals that represent a sound field as a function of direction with higher-order terms. For example, a gain function for the SE loudspeaker channel that includes terms up to the third-order may be expressed as:

$$\text{Gain}_{SE}(\theta)=a_0+a_1\cos\theta+b_1\sin\theta+a_2\cos 2\theta+b_2\sin 2\theta+a_3\cos 3\theta+b_3\sin 3\theta \tag{8}$$

Figure 6:
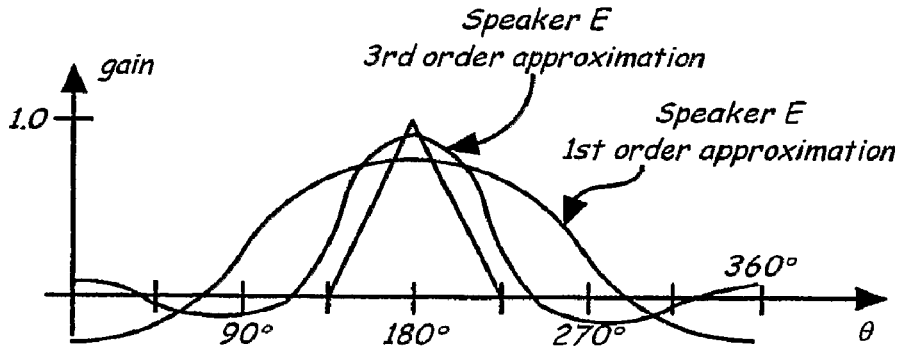
FIG. 6 is a graphical illustration of gain functions that include third-order signals.
Figure 7A:
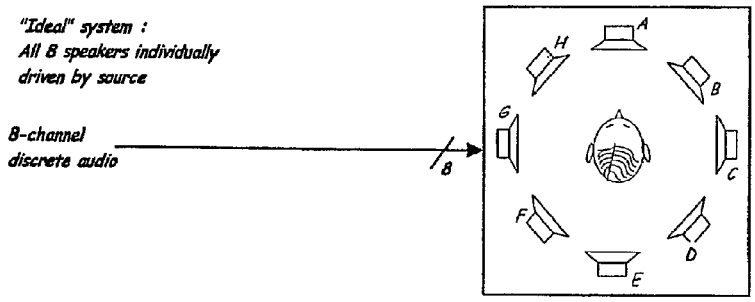
FIGS. 7A through 7D are schematic block diagrams of hypothetical exemplary playback systems.
Figure 7B:
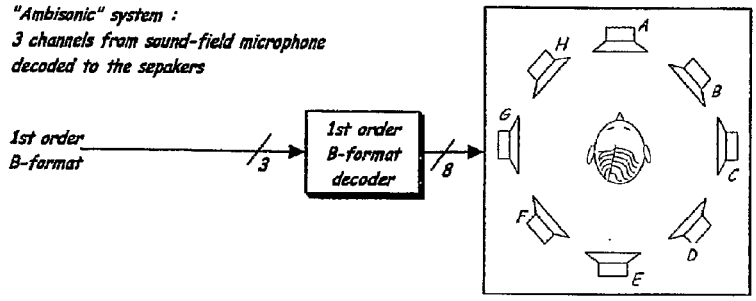
Figure 7C:
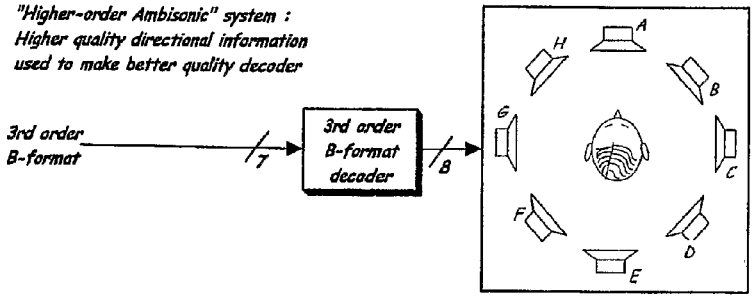
Figure 7D:
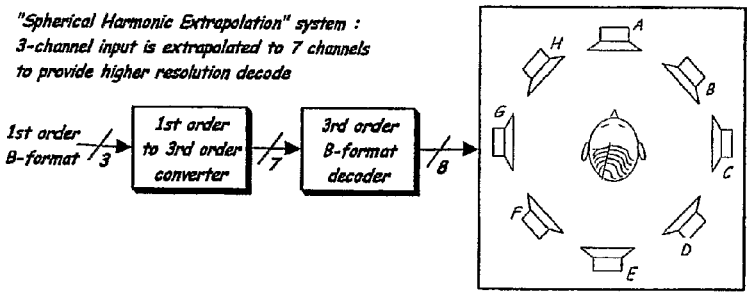

A gain function that includes third-order terms can provide a closer approximation to the desired NSAP gain curve as illustrated in FIG. 6.

Second-order and third-order angular terms could be obtained by using a microphone system that captures second-order and third-order sound field components but this would require acoustic transducers with second-order and third-order directional patterns of sensitivity. Transducers with higher-order directional sensitivities are very difficult to manufacture. In addition, this approach would not provide any solution for the playback of signals that were recorded using transducers with first-order directional patterns of sensitivity.

The schematic block diagrams shown in FIGS. 7A through 7D illustrate different hypothetical playback systems that may be used to generate a multi-dimensional sound field in response to different types of input signals. The playback system illustrated in FIG. 7A drives eight loudspeakers in response to eight discrete input signals. The playback systems illustrated in FIGS. 7B and 7C drive eight loudspeakers in response to first and third-order B-format input signals, respectively, using a decoder 17 that performs a decoding process that is appropriate for the format of the input signals. The playback system illustrated in FIG. 7D incorporates various features of the present invention in which the decoder 17 processes three-channel (W, X, Y) B-format zero-order and first-order signals to derive processed signals that approximate the signals that could have been obtained from a microphone system using transducers with second-order and third-order gain patterns. The following discussion describes different methods that may be used to derive these processed signals.

E. Deriving Higher Order Terms

Two basic approaches for deriving higher-order angular terms are described below. The first approach derives the angular terms for wideband signals. The second approach is a variation of the first approach that derives the angular terms for frequency subbands. The techniques may be used to generate signals with higher-order components. In addition, these techniques may be applied to the four-channel B-format signals for three-dimensional applications.

1. Wideband Approach

FIG. 8 is a schematic block diagram of a wideband approach for deriving higher-order terms from three-channel (W, X, Y) B-format signals. Four statistical characteristics denoted as $C_1$=an estimate of cos θ(t);

$S_1$=an estimate of sin θ(t);

$C_2$=an estimate of cos 2θ(t); and $S_2$=an estimate of sin 2θ(t).

are derived from an analysis of the B-format signals and these characteristics are used to generate estimates of the second-order and third-order terms, which are denoted as:

$$X_2=\text{Signal}\cdot\cos 2\theta(t)$$

$$Y_2=\text{Signal}\cdot\sin 2\theta(t)$$

$$X_3=\text{Signal}\cdot\cos 3\theta(t)$$

$$Y_3=\text{Signal}\cdot\sin 3\theta(t)$$

One technique for obtaining the four statistical characteristics assumes that at any particular instant t most of the acoustic energy incident on the microphone system 15 arrives from a single angular direction, which makes azimuth a function of time that can be denoted as θ(t). As a result, the W, X and Y-channel signals are assumed to be essentially of the form:

$$W=\text{Signal}$$

$$X=\text{Signal}\cdot\cos\theta(t)$$

$$Y=\text{Signal}\cdot\sin\theta(t)$$

Estimates of the four statistical characteristics of angular directions of the acoustic energy can be derived from equations 9a through 9d shown below, in which the notation Av(x) represents an average value of the signal x. This average value may be calculated over a period of time that is relatively short as compared to the interval over which signal characteristics change significantly.

$$C_1=\frac{2Av(W\times X)}{Av(W^2)+Av(X^2)+Av(Y^2)}=\frac{2Av(\text{Signal}\cdot\text{Signal}\cdot\cos\theta)}{Av(Signal^2+Signal^2\cdot cos^2\theta+Signal^2\cdot sin^2\theta)}=\cos\theta \tag{9a}$$

$$S_1=\frac{2Av(W\times Y)}{Av(W^2)+Av(X^2)+Av(Y^2)}=\frac{2Av(\text{Signal}\cdot\text{Signal}\cdot\cos\theta)}{Av(Signal^2+Signal^2\cdot cos^2\theta+Signal^2\cdot sin^2\theta)}=\sin\theta \tag{9b}$$

$$C_2=\frac{2Av(X^2)-2Av(Y^2)}{Av(W^2)+Av(X^2)+Av(Y^2)}=\frac{2Av(Signal^2\cdot cos^2\theta-Signal^2\cdot\sin^2\theta)}{Av(Signal^2+Signal^2\cdot cos^2\theta+Signal^2\cdot sin^2\theta)}=cos^2\theta-sin^2\theta=\cos 2\theta \tag{9c}$$

$$S_2=\frac{4Av(X\times Y)}{Av(W^2)+Av(X^2)+Av(Y^2)}=\frac{4Av(Signal^2\cdot\cos\theta\cdot\sin\theta)}{Av(Signal^2+Signal^2\cdot cos^2\theta+Signal^2\cdot sin^2\theta)}=2\cos\theta\cdot\sin\theta=\sin 2\theta \tag{9d}$$

Other techniques may be used to obtain estimates of the four statistical characteristics $S_1$, $C_1$, $S_2$, $C_2$, as discussed below.

The four signals $X_2$, $Y_2$, $X_3$, $Y_3$ mentioned above can be generated from weighted combinations of the W, X and Y-channel signals using the four statistical characteristics as weights in any of several ways by using the following trigonometric identities:

$$\cos 2\theta\equiv\cos^2\theta-\sin^2\theta$$

$$\sin 2\theta\equiv 2\cos\theta\cdot\sin\theta$$

$$\cos 3\theta\equiv\cos\theta\cdot\cos 2\theta-\sin\theta\cdot\sin 2\theta$$

$$\sin 3\theta\equiv\cos\theta\cdot\sin 2\theta+\sin\theta\cdot\cos 2\theta$$

The $X_2$ signal can be obtained from any of the following weighted combinations:

$$X_2=\text{Signal}\cdot\cos 2\theta=W\cdot C_2 \tag{10a}$$

$$X_2=\text{Signal}\cdot\cos 2\theta=\text{Signal}\cdot(\cos^2\theta-\sin^2\theta)=X\cdot C_1-Y\cdot S_1 \tag{10b}$$

$$X_2=\tfrac{1}{2}(W\cdot C_2+X\cdot C_1-Y\cdot S_1) \tag{10c}$$

The value calculated in equation 10c is an average of the first two expressions. The $Y_2$ signal can be obtained from any of the following weighted combinations:

$$Y_2=\text{Signal}\cdot\sin 2\theta=W\cdot S_2 \tag{11a}$$

$$Y_2=\text{Signal}\cdot\sin 2\theta=\text{Signal}\cdot(2\cos\theta\cdot\sin\theta)=X\cdot S_1+Y\cdot C_1 \tag{11b}$$

$$Y_2=\tfrac{1}{2}(W\cdot S_2+X\cdot S_1+Y\cdot C_1) \tag{11c}$$

The value calculated in equation 11c is an average of the first two expressions. The third-order signals can be obtained from the following weighted combinations:

$$X_3=\text{Signal}\cdot\cos 3\theta=X\cdot C_2-Y\cdot S_2 \tag{12}$$

$$Y_3=\text{Signal}\cdot\cos 3\theta=X\cdot S_2+Y\cdot C_2 \tag{13}$$

Other weighted combinations may be used to calculate the four signals $X_2$, $Y_2$, $X_3$, $Y_3$. The equations shown above are merely examples of calculations that may be used.

Other techniques may be used to derive the four statistical characteristics. For example, if sufficient processing resources are available, it may be practical to obtain C1 from the following equation:

$$C_1(n) = \frac{2\sum_{k=0}^{K-1} W(n-k)\cdot X(n-k)}{\sum_{k=0}^{K-1} (W(n-k)^2 + X(n-k)^2 + Y(n-k)^2)} \tag{14a}$$

This equation calculates the value of $C_1$ at sample n by analyzing the W, X and Y-channel signals over the previous K samples.

Another technique that may be used to obtain C1 is a calculation using a first-order recursive smoothing filter in place of the finite sums in equation 14a, as shown in the following equation:

$$C_1(n) = \frac{2\sum_{k=0}^{\infty} W(n-k)\cdot X(n-k)\cdot(1-\alpha)^k}{\sum_{k=0}^{\infty} (W(n-k)^2 + X(n-k)^2 + Y(n-k)^2)\cdot(1-\alpha)^k} \tag{14b}$$

Figure 10:
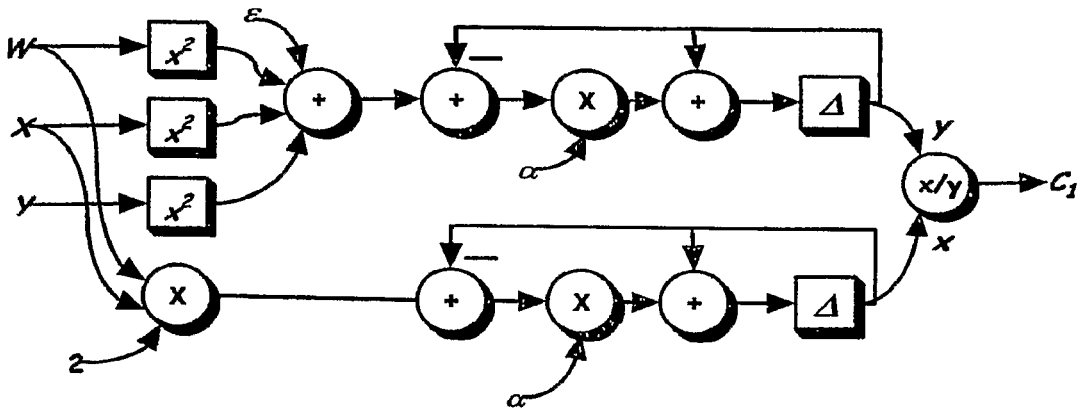
FIGS. 10 through 12 are schematic block diagrams of circuits that may be used to derive statistical characteristics of three-channel B-format signals.

The time-constant of the smoothing filter is determined by the factor $\alpha$. This calculation may be performed as shown in the block diagram illustrated in FIG. 10. Divide-by-zero errors that would occur when the denominator of the expression in equation 14b is equal to zero can be avoided by adding a small value $\epsilon$ to the denominator as shown in the figure. This modifies the equation slightly as follows:

$$C_1(n) = \frac{2\sum_{k=0}^{\infty} W(n-k)\cdot X(n-k)\cdot(1-\alpha)^k}{\sum_{k=0}^{\infty} (W(n-k)^2 + X(n-k)^2 + Y(n-k)^2 + \varepsilon)\cdot(1-\alpha)^k} \tag{14c}$$

Figure 11:
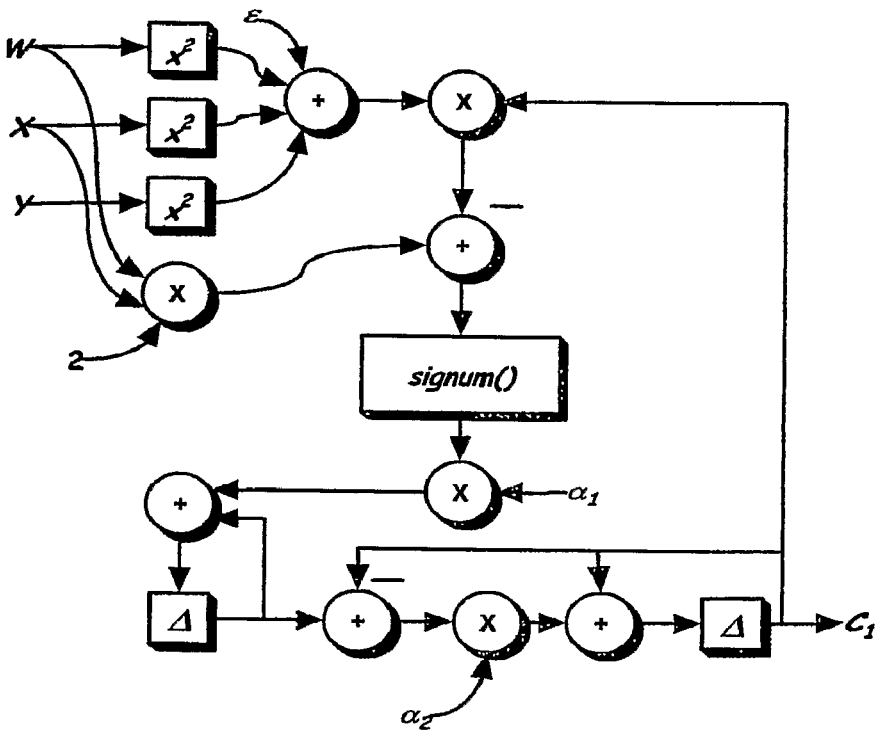

The divide-by-zero error can also be avoided by using a feed-back loop as shown in FIG. 11. This technique uses the previous estimate $C_1(n-1)$ to compute the following error function:

$$\mathrm{Err}(n)=2W(n)\cdot X(n)-C_1(n-1)\cdot(W(n)^2+X(n)^2+Y(n)^2+\epsilon) \tag{15}$$

If the value of the error function is greater than zero, the previous estimate of $C_1$ is too small, the value of signum(Err(n)) is equal to one and the estimate is increased by an adjustment amount equal to $\alpha_1$. If the value of the error function is less than zero, the previous estimate of $C_1$ is too large, the function signum(Err(n)) is equal to negative one and the estimate is decreased by an adjustment amount equal to $\alpha_1$. If the value of the error function is zero, the previous estimate of $C_1$ is correct, the function signum(Err(n)) is equal to zero and the estimate is not changed. A coarse version of the $C_1$ estimate is generated in the storage or delay element shown in the lower-left portion of the block diagram illustrated in FIG. 11, and a smoothed version of this estimate is generated at the output labeled $C_1$ in the lower-right portion of the block diagram. The time-constant of the smoothing filter is determined by the factor $\alpha_2$.

Figure 12:
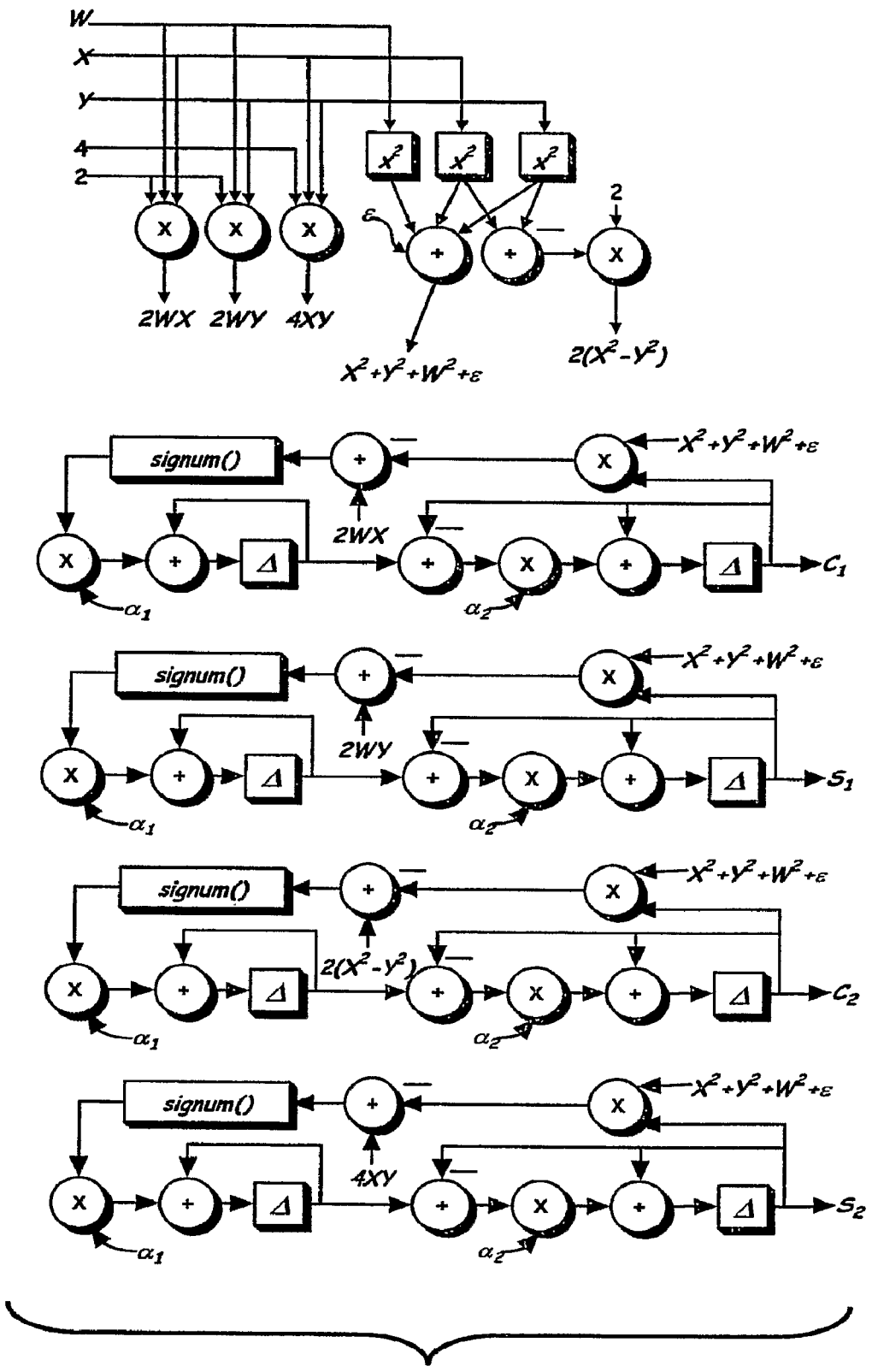
Figure 13:
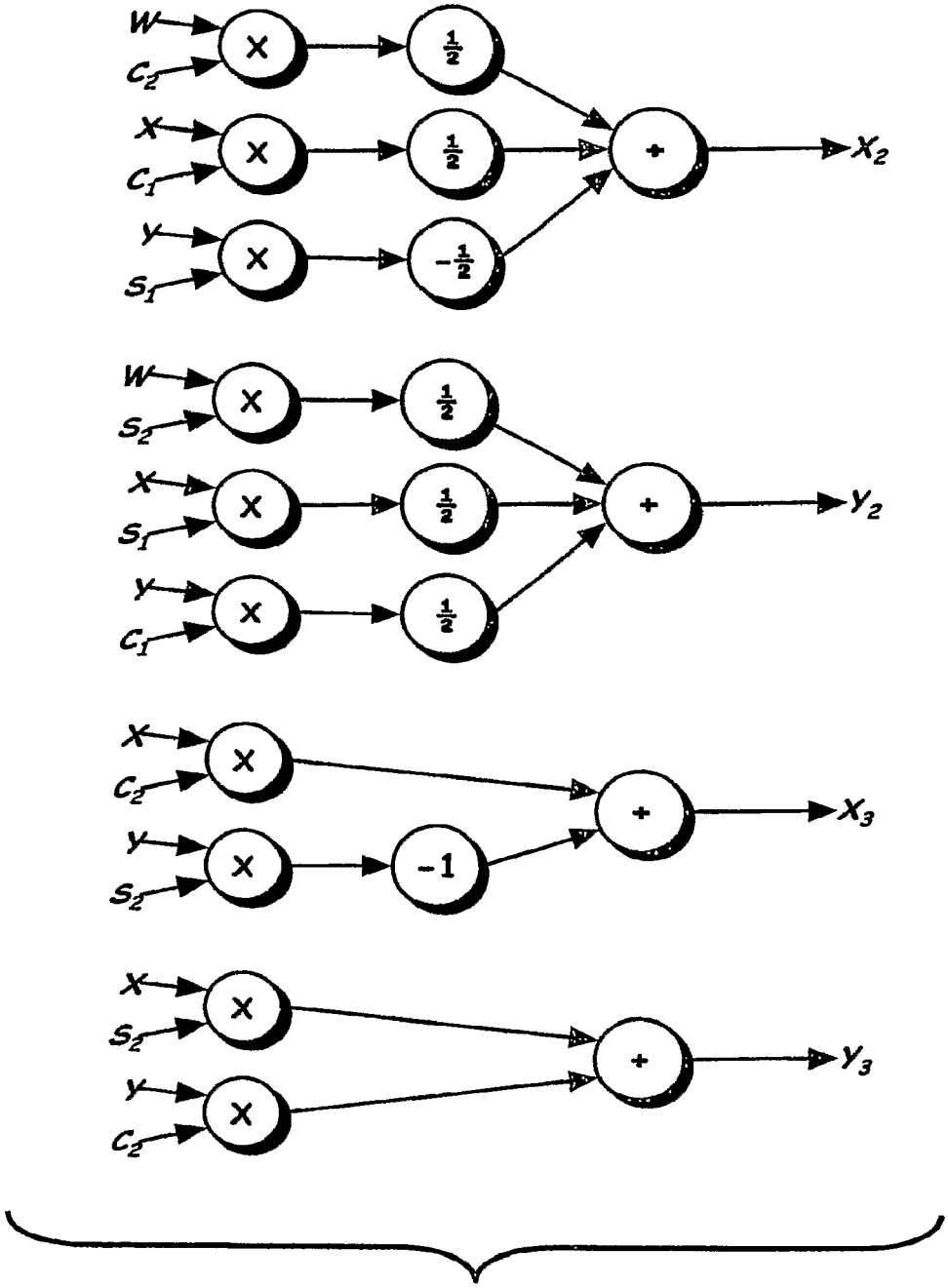
FIG. 13 illustrates schematic block diagrams of circuits that may be used to generate second and third-order signals from statistical characteristics of three-channel B-format signals.

The four statistical characteristics $C_1$, $S_1$, $C_2$, $S_2$ can be obtained using circuits and processes corresponding to the block diagrams shown in FIG. 12. Signals $X_2$, $Y_2$, $X_3$, $Y_3$ with higher-order terms can be obtained according to equations 10c, 11c, 12 and 13 by using circuits and processes corresponding to the block diagrams shown in FIG. 13.

Figure 9:
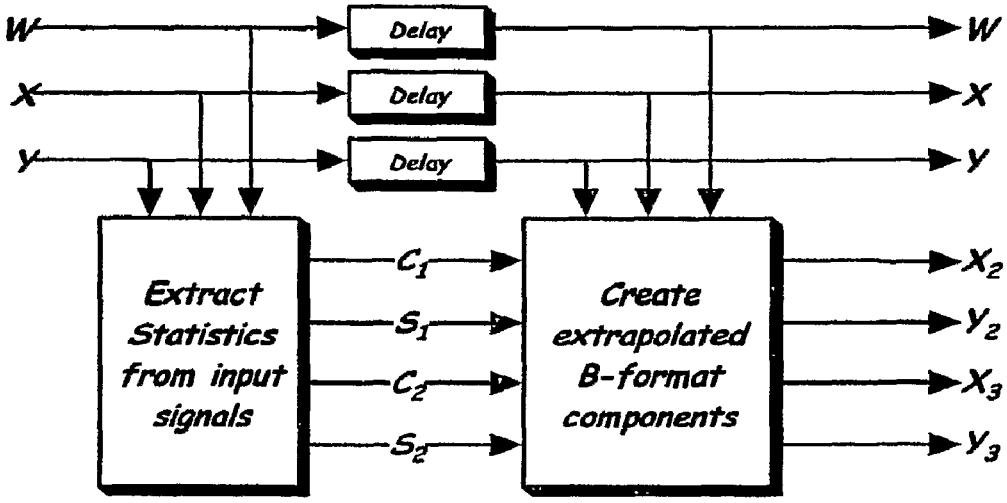

The processes used to derive the four statistical characteristics from the W, X and Y-channel input signals will incur some delay if these processes use time-averaging techniques. In a real-time system, it may be advantageous to add some delay to the input signal paths as shown in FIG. 9 to compensate for the delay in the statistical derivation. A typical value of delay for statistical analysis in many implementations is between 10 ms and 50 ms. The delay inserted into the input signal path should generally be less than or equal to the statistical analysis delay. In many implementations, the signal-path delay can be omitted without significant degradation in the overall performance of the system.

2. Multiband Approach

The techniques discussed above derive wideband statistical characteristics that can be expressed as scalar values that vary with time but do not vary with frequency. The derivation techniques can be extended to derive frequency-band dependent statistical characteristics that can be expressed as vectors with elements corresponding to a number of different frequencies or different frequency subbands. Alternatively, each of the frequency-dependent statistical characteristics $C_1$, $S_1$, $C_2$ and $S_2$ may be expressed as an impulse response.

If the elements in each of the $C_1$, $S_1$, $C_2$ and $S_2$ vectors are treated as frequency-dependent gain values, weighted combinations of the $X_2$, $Y_2$, $X_3$ and $Y_3$ signals can be generated by applying an appropriate filter to the W, X and Y-channel signals that have frequency responses based on the gain values in these vectors. The multiply operations shown in the previous equations and diagrams are replaced by a filtering operation such as convolution.

The statistical analysis of the W, X and Y-channel signals may be performed in the frequency domain or in the time domain. If the analysis is performed in the frequency domain, the input signals can be transformed into a short-time frequency domain using a block Fourier transform or similar to generate frequency-domain coefficients and the four statistical characteristics can be computed for each frequency-domain coefficient or for groups of frequency-domain coefficients defining frequency subbands. The process used to generate the $X_2$, $Y_2$, $X_3$ and $Y_3$ signals can do this processing on a coefficient-by-coefficient basis or on a band-by-band basis.

F. Implementation in a Microphone System

Figure 14:
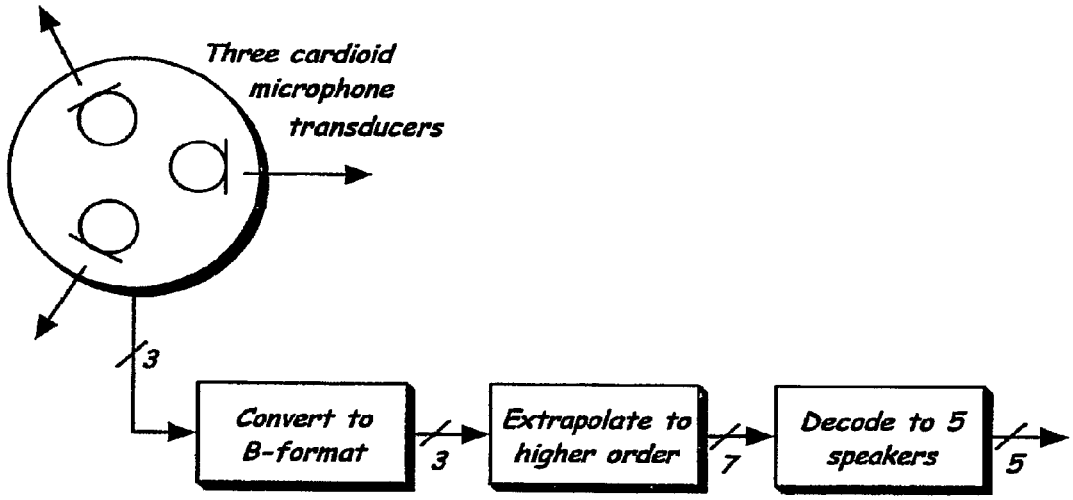
FIG. 14 is a schematic block diagram of a microphone system that incorporates various aspects of the present invention.

The techniques discussed above can be incorporated into a transducer/processor arrangement to form a microphone system 15 that can provide output signals with improved spatial accuracy. In one implementation shown schematically in FIG. 14, the microphone system 15 comprises three co-incident or nearly co-incident acoustic transducers A, B, C having cardioid-shaped directional patterns of sensitivity that are arranged at the vertices of an equilateral triangle with each transducer facing outward away from the center of the triangle. The transducer directional gain patterns can be expressed as:

$$\text{Gain}_A(\theta)=\tfrac{1}{2}+\tfrac{1}{2}\cos\theta \quad (16a)$$

$$\text{Gain}_B(\theta)=\tfrac{1}{2}+\tfrac{1}{2}\cos(\theta-120°) \quad (16b)$$

$$\text{Gain}_C(\theta)=\tfrac{1}{2}+\tfrac{1}{2}\cos(\theta+120°) \quad (16c)$$

where transducer A faces forward along the X-axis, transducer B faces backward and to the left at an angle of 120 degrees from the X-axis, and transducer C faces backward and to the right at an angle of 120 degrees from the X-axis.

The output signals from these transducers can be converted into three-channel (W, X, Y) first-order B-format signals as follows:

$$\begin{aligned} W &= \frac{2}{3}[Gain_A(\theta)+Gain_B(\theta)+Gain_C(\theta)] \\ &= \frac{2}{3}\left[\frac{1}{2}+\frac{1}{2}\cos\theta+\frac{1}{2}+\frac{1}{2}\cos(\theta-120^\circ)+\frac{1}{2}+\frac{1}{2}\cos(\theta+120^\circ)\right] \\ &= 1 \end{aligned} \quad (17a)$$

$$\begin{aligned} X &= \frac{4}{3}Gain_A(\theta)-\frac{2}{3}Gain_B(\theta)-\frac{2}{3}Gain_C(\theta) \\ &= \frac{4}{3}\left[\frac{1}{2}+\frac{1}{2}\cos\theta\right]-\frac{2}{3}\left[\frac{1}{2}+\frac{1}{2}\cos(\theta-120^\circ)\right]- \\ &\quad \frac{2}{3}\left[\frac{2}{3}+\frac{1}{2}\cos(\theta+120^\circ)\right] \\ &= \cos\theta \end{aligned} \quad (17b)$$

$$\begin{aligned} Y &= \frac{2}{\sqrt{3}}Gain_B(\theta)-\frac{2}{\sqrt{3}}Gain_B(\theta) \\ &= \frac{2}{\sqrt{3}}\left[\frac{1}{2}+\frac{1}{2}\cos(\theta+120^\circ)\right]-\frac{2}{\sqrt{3}}\left[\frac{1}{2}+\frac{1}{2}\cos(\theta-120^\circ)\right] \\ &= \sin\theta \end{aligned} \quad (17c)$$

Figure 15A:
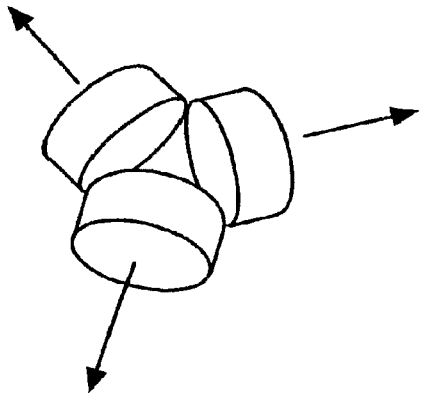
FIGS. 15A and 15B are schematic diagrams of alternative arrangements of transducers in a microphone system.
Figure 15B:
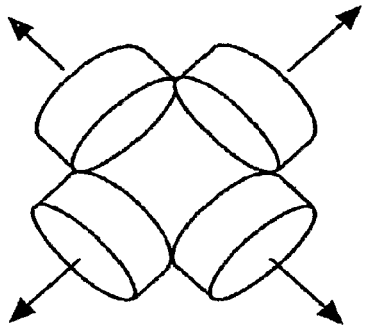

A minimum of three transducers is required to capture the three-channel B-format signals. In practice, when low-cost transducers are used, it may be preferable to use four transducers. The schematic diagrams shown in FIGS. 15A and 15B illustrate two alternative arrangements. A three-transducer array may be arranged with the transducers facing at different angles such as 60, −60 and 180 degrees. A four-transducer array may be arranged in a so-called "Tee" configuration with the transducers facing at 0, 90, −90 and 180 degrees, or arranged in a so-called "Cross" configuration with the transducers facing at 45, −45, 135 and −135 degrees. The gain patterns for the Cross configuration are:

$$\text{Gain}_{LF}(\theta)=\tfrac{1}{2}+\tfrac{1}{2}\cos(\theta-45°) \quad (18a)$$

$$\text{Gain}_{RF}(\theta)=\tfrac{1}{2}+\tfrac{1}{2}\cos(\theta+45°) \quad (18b)$$

$$\text{Gain}_{LB}(\theta)=\tfrac{1}{2}+\tfrac{1}{2}\cos(\theta-135°) \quad (18c)$$

$$\text{Gain}_{RB}(\theta)=\tfrac{1}{2}+\tfrac{1}{2}\cos(\theta+135°) \quad (18d)$$

where the subscripts LF, RF, LB and RB denote gains for the transducers facing in the left-forward, right-forward, left-backward and right-backward directions.

The output signals from the Cross configuration of transducers can be converted into the three-channel (W, X, Y) first-order B-format signals as follows:

$$W = \frac{1}{2}[Gain_{LF}(\theta)+Gain_{RF}(\theta)+Gain_{LB}(\theta)+Gain_{RB}(\theta)] = 1 \quad (19a)$$

$$X = \frac{1}{\sqrt{2}}[Gain_{LF}(\theta)+Gain_{RF}(\theta)-Gain_{LB}(\theta)-Gain_{RB}(\theta)] = \cos\theta \quad (19b)$$

$$Y = \frac{1}{\sqrt{2}}[Gain_{LF}(\theta)-Gain_{RF}(\theta)+Gain_{LB}(\theta)-Gain_{RB}(\theta)] = \sin\theta \quad (19c)$$

In actual practice, the directional gain patterns for each transducer deviates from the ideal cardioid pattern. The conversion equations shown above can be adjusted to account for these deviations. In addition, the transducers may have poorer directional sensitivity at lower frequencies; however, this property can be tolerated in many applications because listeners are generally less sensitive to directional errors at lower frequencies.

G. Mixing Equations

The set of seven first, second and third-order signals (W, X, Y, $X_2$, $Y_2$, $X_3$, $Y_3$) may be mixed or combined by a matrix to drive a desired number of loudspeakers. The following set of mixing equations define a 7×5 matrix that may be used to drive five loudspeakers in a typical surround-sound configuration including left (L), right (R), center (C), left-surround (LS) and right-surround (RS) channels:

$$\begin{bmatrix} S_L \\ S_C \\ S_R \\ S_{LS} \\ S_{RS} \end{bmatrix} = \begin{bmatrix} 0.2144 & 0.1533 & 0.3498 & -0.1758 & 0.1971 & -0.1266 & -0.0310 \\ 0.1838 & 0.3378 & 0.0000 & 0.2594 & 0.0000 & 0.1598 & 0.0000 \\ 0.2144 & 0.1533 & -0.3498 & -0.1758 & -0.1971 & -0.1266 & 0.0310 \\ 0.2451 & -0.3227 & 0.2708 & 0.0448 & -0.2539 & 0.0467 & 0.0809 \\ 0.2451 & -0.3227 & -0.2708 & 0.0448 & 0.2539 & 0.0467 & -0.0809 \end{bmatrix} \cdot \begin{bmatrix} W \\ X \\ Y \\ X_2 \\ Y_2 \\ X_3 \\ Y_3 \end{bmatrix}$$

Figure 16:
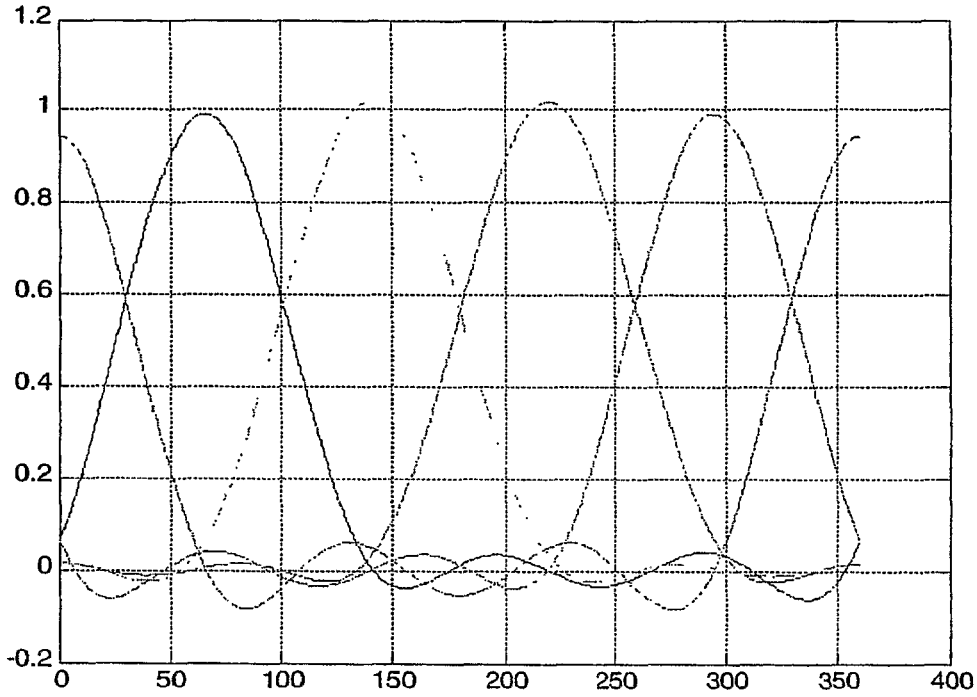
FIG. 16 is a graphical illustration of hypothetical gain functions for loudspeaker channels in a playback system.

The loudspeaker gain functions that are provided by these mixing equations are illustrated graphically in FIG. 16. These gain functions assume the mixing matrix is fed with an ideal set of input signals.

H. Implementation

Figure 17:
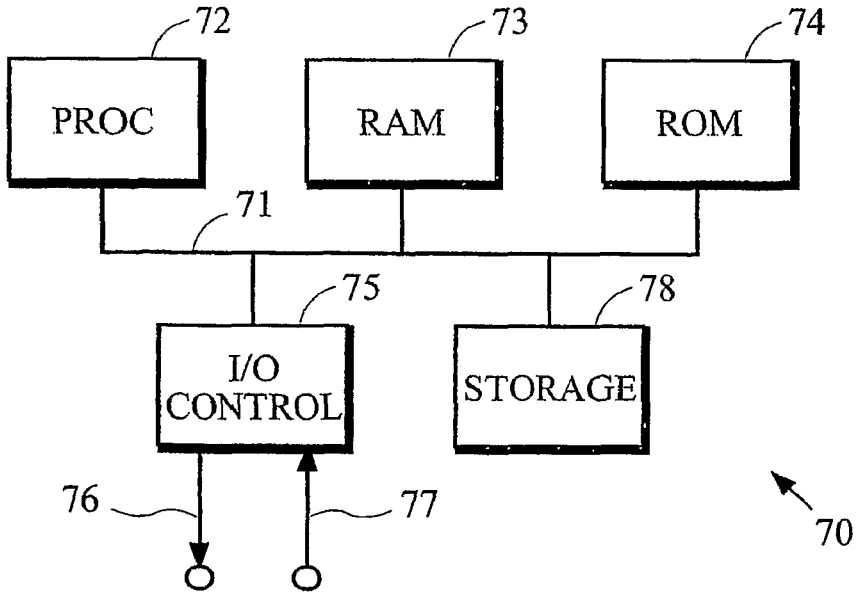
FIG. 17 is a schematic block diagram of a device that may be used to implement various aspects of the present invention.

Devices that incorporate various aspects of the present invention may be implemented in a variety of ways including software for execution by a computer or some other device that includes more specialized components such as digital signal processor (DSP) circuitry coupled to components similar to those found in a general-purpose computer. FIG. 17 is a schematic block diagram of a device 70 that may be used to implement aspects of the present invention. The processor 72 provides computing resources. RAM 73 is system random access memory (RAM) used by the processor 72 for processing. ROM 74 represents some form of persistent storage such as read only memory (ROM) or flash memory for storing programs needed to operate the device 70 and possibly for carrying out various aspects of the present invention. I/O control 75 represents interface circuitry to receive and transmit signals by way of the communication channels 76, 77. In the embodiment shown, all major system components connect to the bus 71, which may represent more than one physical or logical bus; however, a bus architecture is not required to implement the present invention.

The storage device 78 is optional. Programs that implement various aspects of the present invention may be recorded on a storage device 78 having a storage medium such as magnetic tape or disk, or an optical medium. The storage medium may also be used to record programs of instructions for operating systems, utilities and applications.

The functions required to practice various aspects of the present invention can be performed by components that are implemented in a wide variety of ways including discrete logic components, integrated circuits, one or more ASICs and/or program-controlled processors. The manner in which these components are implemented is not important to the present invention.

Software implementations of the present invention may be conveyed by a variety of machine readable media such as baseband or modulated communication paths throughout the spectrum including from supersonic to ultraviolet frequencies, or storage media that convey information using essentially any recording technology including magnetic tape, cards or disk, optical cards or disc, and detectable markings on media including paper.

The invention claimed is:

1. A method for increasing spatial resolution of audio signals representing a sound field, the method comprising:

receiving three or more input audio signals that represent the sound field as a function of angular direction with zero-order and first-order angular terms;

analyzing the three or more input audio signals to derive statistical characteristics of one or more angular directions of acoustic energy in the sound field;

deriving two or more processed signals from weighted combinations of the three or more input audio signals in which the three or more audio signals are weighted according to the statistical characteristics, wherein the two or more processed signals represent the sound field as a function of angular direction with angular terms of one or more orders greater than one;

providing five or more output audio signals that represent the sound field as a function of angular direction with angular terms of order zero, one and greater than one, wherein the five or more output audio signals comprise the three or more input audio signals and the two or more processed signals.

2. The method according to claim 1, wherein the three or more input audio signals are received from a plurality of acoustic transducers each having directional sensitivities with angular terms of an order no greater than first order.

3. The method according to claim 1 that derives from the statistical characteristics four or more processed signals that represent the sound field as a function of angular direction with angular terms of two or more orders greater than one.

4. The method according to claim 1 wherein the statistical characteristics are derived at least in part by applying a smoothing filter to values derived from the three or more input audio signals.

5. The method according to claim 1 wherein the statistical characteristics represent characteristics of the sound field expressed as a sine function or cosine function of a first-order term of angular direction.

6. The method according to claim 1 that derives frequency-dependent statistical characteristics for the three or more input audio signals.

7. The method according to claim 6 that comprises:

applying a block transform to the three or more input audio signals to generate frequency-domain coefficients;

deriving the frequency-dependent statistical characteristics from individual frequency-domain coefficients or groups of frequency-domain coefficients; and deriving the two or more processed signals by applying filters to the three or more input audio signals having frequency responses based on the frequency-dependent statistical characteristics.

8. The method according to claim 6 that comprises deriving the two or more processed signals by applying filters to the three or more input audio signals having impulse responses based on the frequency-dependent statistical characteristics.

9. An apparatus for increasing spatial resolution of audio signals representing a sound field, the apparatus comprising:

means for receiving three or more input audio signals that represent the sound field as a function of angular direction with zero-order and first-order angular terms;

means for analyzing the three or more input audio signals to derive statistical characteristics of one or more angular directions of acoustic energy in the sound field;

means for deriving two or more processed signals from weighted combinations of the three or more input audio signals in which the three or more audio signals are weighted according to the statistical characteristics, wherein the two or more processed signals represent the sound field as a function of angular direction with angular terms of one or more orders greater than one;

means for providing five or more output audio signals that represent the sound field as a function of angular direction with angular terms of order zero, one and greater than one, wherein the five or more output audio signals comprise the three or more input audio signals and the two or more processed signals.

10. The apparatus according to claim 9, wherein the three or more input audio signals are received from a plurality of acoustic transducers each having directional sensitivities with angular terms of an order no greater than first order.

11. The apparatus according to claim 9 that derives from the statistical characteristics four or more processed signals that represent the sound field as a function of angular direction with angular terms of two or more orders greater than one.

12. The apparatus according to claim 9 wherein the statistical characteristics are derived at least in part by applying a smoothing filter to values derived from the three or more input audio signals.

13. The apparatus according to claim 9 wherein the statistical characteristics represent characteristics of the sound field expressed as a sine function or cosine function of a first-order term of angular direction.

14. The apparatus according to claim 9 that derives frequency-dependent statistical characteristics for the three or more input audio signals.

15. The apparatus according to claim 14 that comprises:

means for applying a block transform to the three or more input audio signals to generate frequency-domain coefficients;

means for deriving the frequency-dependent statistical characteristics from individual frequency-domain coefficients or groups of frequency-domain coefficients; and means for deriving the two or more processed signals by applying filters to the three or more input audio signals having frequency responses based on the frequency-dependent statistical characteristics.

16. The apparatus according to claim 14 that comprises means for deriving the two or more processed signals by applying filters to the three or more input audio signals having impulse responses based on the frequency-dependent statistical characteristics.

17. A computer-readable storage medium recording a program of instructions executable by a processor, wherein execution of the program of instructions causes the processor to perform a method for increasing spatial resolution of audio signals representing a sound field, the method comprising:

receiving three or more input audio signals that represent the sound field as a function of angular direction with zero-order and first-order angular terms;

analyzing the three or more input audio signals to derive statistical characteristics of one or more angular directions of acoustic energy in the sound field;

deriving two or more processed signals from weighted combinations of the three or more input audio signals in which the three or more audio signals are weighted according to the statistical characteristics, wherein the two or more processed signals represent the sound field as a function of angular direction with angular terms of one or more orders greater than one;

providing five or more output audio signals that represent the sound field as a function of angular direction with angular terms of order zero, one and greater than one, wherein the five or more output audio signals comprise the three or more input audio signals and the two or more processed signals.

18. The storage medium according to claim 17 wherein the three or more input audio signals are received from a plurality of acoustic transducers each having directional sensitivities with angular terms of an order no greater than first order.

19. The storage medium according to claim 17 wherein the method derives from the statistical characteristics four or more processed signals that represent the sound field as a function of angular direction with angular terms of two or more orders greater than one.

20. The storage medium according to claim 17 wherein the statistical characteristics are derived at least in part by applying a smoothing filter to values derived from the three or more input audio signals.

21. The storage medium according to claim 17 wherein the statistical characteristics represent characteristics of the sound field expressed as a sine function or cosine function of a first-order term of angular direction.

22. The storage medium according to claim 17 wherein the method derives frequency-dependent statistical characteristics for the three or more input audio signals.

23. The storage medium according to claim 22, wherein the method comprises:

applying a block transform to the three or more input audio signals to generate frequency-domain coefficients;

deriving the frequency-dependent statistical characteristics from individual frequency-domain coefficients or groups of frequency-domain coefficients; and deriving the two or more processed signals by applying filters to the three or more input audio signals having frequency responses based on the frequency-dependent statistical characteristics.

24. The storage medium according to claim 22, wherein the method comprises deriving the two or more processed signals by applying filters to the three or more input audio signals having impulse responses based on the frequency-dependent statistical characteristics.

* * * * *